US005661867A

United States Patent [19]

Elliott

[11] Patent Number: 5,661,867

[45] Date of Patent: Sep. 2, 1997

[54] POOL TABLE BRUSH

[76] Inventor: LaMar Elliott, 2330 S. Kearney, Denver, Colo. 80222

[21] Appl. No.: 680,677

[22] Filed: Jul. 16, 1996

[51] Int. Cl.[6] ..... A46B 3/18; A46B 15/00

[52] U.S. Cl. ..... 15/160; 15/106; 15/206; D4/119; D4/128; D4/131

[58] Field of Search ..... 15/106, 159.1, 15/160, 206; D4/119, 120, 127, 128, 130–135

[56] References Cited

U.S. PATENT DOCUMENTS

| | | | |
|---|---|---|---|
| D. 25,518 | 5/1896 | Young | D4/129 |
| D. 25,894 | 8/1896 | Robinson | D4/129 |
| 166,789 | 8/1875 | Leiner | 15/206 |
| D. 250,068 | 10/1978 | Ducotey | 15/206 X |
| D. 250,677 | 1/1979 | Love . | |
| D. 283,851 | 5/1986 | Walko | D4/130 |
| 582,478 | 5/1897 | Leiner | 15/206 |
| 616,677 | 12/1898 | Leiner | 15/206 X |
| 1,603,560 | 10/1926 | Skinner | 15/206 |
| 2,123,044 | 7/1938 | Hertzberg | 15/206 |
| 2,183,139 | 12/1939 | Hertzberg | 15/206 |
| 2,838,777 | 6/1958 | Schoenfield et al. | 15/106 X |
| 4,195,381 | 4/1980 | Jurich, III | 15/160 X |
| 5,319,823 | 6/1994 | Baum et al. | 15/160 |
| 5,440,775 | 8/1995 | Banks | 15/106 |

FOREIGN PATENT DOCUMENTS

| | | | |
|---|---|---|---|
| 11735 | 3/1933 | Australia | 15/106 |
| 977110 | 11/1975 | Canada | 15/206 |
| 129236 | 3/1902 | Germany . | |
| 601559 | 8/1934 | Germany | 15/160 |
| 651854 | 10/1937 | Germany | 15/106 |
| 12310 | of 1915 | United Kingdom | 15/206 |

OTHER PUBLICATIONS

Oram Brushes and Noel Ltd., May 1962, p. 44.

*Primary Examiner*—Mark Spisich

*Attorney, Agent, or Firm*—Ramon L. Pizarro; Edwin H. Crabtree

[57] ABSTRACT

A brush for cleaning a pool table. The brush includes a handle with a first resilient support for supporting bristles and a second mounting support for supporting bristles. The first mounting support projects a first distance from the handle and the second mounting support projects a second distance from the handle. The first mounting support and the second mounting support are mounted on the handle in a spaced apart relationship to one another, and the distance of projection from the handle of the first mounting support is greater than the distance of projection from the handle of the second mounting support. Bristles are mounted on the first mounting support and on the second mounting support so that the brush may be used to brush between the bumper and the surface of a pool table as well as over the flat surface of the table and the entrance to the pockets on the table.

14 Claims, 4 Drawing Sheets

POOL TABLE BRUSH

BACKGROUND OF THE INVENTION (a) Field of the Invention

This invention generally relates to field of brushes for billiard or pool tables, and more particularly, but not by way of limitation, to a brush with bristle portions that have been arranged in a manner that is particularly useful for cleaning pool tables.

(b) Discussion of Prior Art

The game of billiards or pool has been enjoyed for several hundred years, with the equipment used remaining relatively unchanged. One of the key features of pool or billiard games is that they require the player to be able predict and control the motion of a pool ball over the pool table. To this end the pool or billiard equipment includes a table that produces low rolling resistance and hard balls, which also offer low rolling resistance.

The pool table typically consists of a heavy platform with a layer of thick stone or other hard material covered by felt. The hard surface produces the low rolling resistance that is required for producing the desired motion of the balls used for playing pool. The felt cover over the stone produces a soft rolling surface which reduces the effect of dirt or other debris which may fall on the hard surface, and protects the surface of the stone and the pool balls, without introducing a significant amount of rolling resistance.

The sides of the table typically include a bumper filled with a resilient material which allows the balls to bounce off of the sides of the pool table. To provide graduated levels of resiliency, the bumpers on a pool table are generally triangular in shape and overhang the borders of the pool table's surface. The bumpers are also covered with a felt material, which allows a smooth bounce or ricochet of the balls off of the sides of the table.

Therefore, it can be appreciated that in order to play billiard type games on a pool table it is important to have a clean surface, so that the rolling motion of the ball is unobstructed, allowing the ball to take the course predicted by the player. It is well known that brushes work well as tools for cleaning debris from the surface of the pool table. However, known brushes have left many of the problems encountered when cleaning the surface of a pool table unsolved. For example, U.S. Des. Pat. No. 283,851 which includes many of the standard features found in pool table brushes. The grip portion of a pool table brush is generally long and narrow, with rounded ends. The bristles near the ends of the brush are generally long and fill the area below the rounded ends of the brush. This configuration has the advantage of offering an easy to grip brush which can fit through the openings in the bumpers, leading to the pockets of the pool table. Also, by pressing firmly on the grip portion one can flatten the long bristles and allow the long bristles to reach below the bumper on the pool table, and thus clean under the bumpers of the table.

The conventional brush also includes an area of shorter bristles below the central or middle area of the brush handle. These shorter bristles serve for general sweeping of the flat surface of the table. The conventional brush has served well for many years, but it has several limitations which do affect the efficiency of the device. For example, when using the conventional brush to clean under the bumpers of the pool table one will discover that the long bristles at the ends of the brush do not easily reach the edge where the bumper and the surface of the table meet. Also, once the handle has been pressed to allow the handle to clear the edge of the bumper and allow the long bristles to reach the edge of intersection, the long bristles are cantilevered for such a great distance from the end of the handle that they are rather ineffective at driving dirt and other debris from below the bumpers.

Also, since the conventional brush includes long bristles at its ends and shorter bristles at the mid-section, it is often difficult to obtain good results while sweeping the flat areas of the table. This is primarily due to the fact that the user must bear down on the brush handle in order to get the shorter bristles to contact the surface of the table. If the user relaxes his or her grip while sweeping, the shorter bristles will be lifted off of the surface of the table, allowing the dirt and debris to pass under the shorter bristles.

Other brush designs, for example, the arrangement taught in U.S. Pat. No. 1,603,560 to Skinner teach the use of spiral bristle clumps which are supported on wires of equal length which hold the spiral bristle clumps close to the brush's handle potion to produce a pair generally flat edges in parallel which can be used to brush flat areas. The Skinner device shows the typical arrangement incorporated when using spiral bristle clumps to create a brush surface. These arrangements typically place several parallel spiral bristle clumps in tandem in order to create allow brushing over a flat surface using the spiral bristle clumps in tandem. Other examples of this general brush design are taught in U.S. Pat. No. 166,789 to Leiner and German patent number 1,603,560 to Gartner.

Other designs which take advantage of versatility of the spiral bristle clump include U.S. Pat. No. 2,183,139 to Hertzberg, and U.S. Pat. No. 2,123,044 to Hertzberg, which use removeable bristle clumps. These brushes, like the other known brush designs which use spiral clumps of bristles arrange the spiral clumps in a manner intended to allow brushing in a direction that is generally perpendicular to the length of the spiral clump.

Thus an examination of the known prior art reveals that the needs and problems encountered while cleaning have not been fully addressed by the known prior art. The approach at providing pool table brushes has produced a generally accepted brush design, which includes a handle with long bristles at the ends, the long bristles defining flat sections at the ends of the brush. Between the areas of long bristles, these brushes include a flat surface of bristles which are shorter than the bristles at the ends of the brush. Other known brush designs simply do not cater to the problems encountered while trying to clean the surface of a pool table properly. Thus there remains a need for brush that is particularly useful for cleaning the surface of a pool table or the like.

More particularly, there remains a need for a pool table brush which can effectively reach under the pool table's bumpers and which can reach the edge where the bumper meets the table's surface while providing sufficient support for the bristles such that the cleaning of these areas can be carried out in an effective manner, that can be used to brush the flat areas of the pool table, and that can reach into the pocket openings on the table's surface.

Also, there remains a need for pool table brush that can be used effectively to clean out around the table's bumpers as well as over the flat areas of the table.

There remains a need for a pool table brush which can be used to clean the flat areas, the bumpers, and the pocket entrances.

There remains a need for an inexpensive pool table brush which can effectively clean the contours of a pool table.

SUMMARY

It has been discovered that the above needs can be met with a pool table brush that includes a body which includes a bristle support system with the following components:

a) a first resilient mounting support for supporting bristles and projecting a first distance from the body of the brush;

b) a second mounting support for supporting bristles the second mounting support projecting a second distance from the body of the brush, the first mounting support being spaced apart from the second mounting support, and bristles projecting from the first mounting support for supporting bristles and from second mounting support for supporting bristles.

In a highly preferred embodiment, the second distance of projection of the second mounting support is greater than the first distance of projection of the first mounting support and the second mounting support for supporting bristles divert from one another. Also, it is preferred that the first mounting support and the second mounting support include a twisted metallic core which holds radially protruding bristles of a resilient material such as plastic or stiff animal hair such as horse hair.

It has been found that by combining the first resilient mounting support for supporting bristles which projects a first distance from the body of the brush, and the second mounting support for supporting bristles which projects a second distance from the body of the brush, with the first mounting support being spaced apart from the second mounting support, one can provide a pool table brush that solves the problems left unanswered by the prior art. For example, the spaced apart bristle mounting supports allow the user to clean over and under the side bumpers of a pool table and clean the flat surface of the pool table. The structure of the disclosed invention provides spaced apart bristle mounting supports which can straddle the pool table's bumpers, thereby allow simultaneous cleaning of the bumper and the crevice between the bumper and the surface of the table. Also, the spaced apart bristle mounting supports are preferably parallel to one another, thereby also providing an even, flat surface which can be used to sweep the surface of the pool table with ease.

Thus it can be appreciated that the instant invention results in a pool table brush which can be used to clean the flat areas, the bumpers, as well as the pocket entrances due to the narrow profile which results from the spaced apart bristle mounting supports.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it is understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
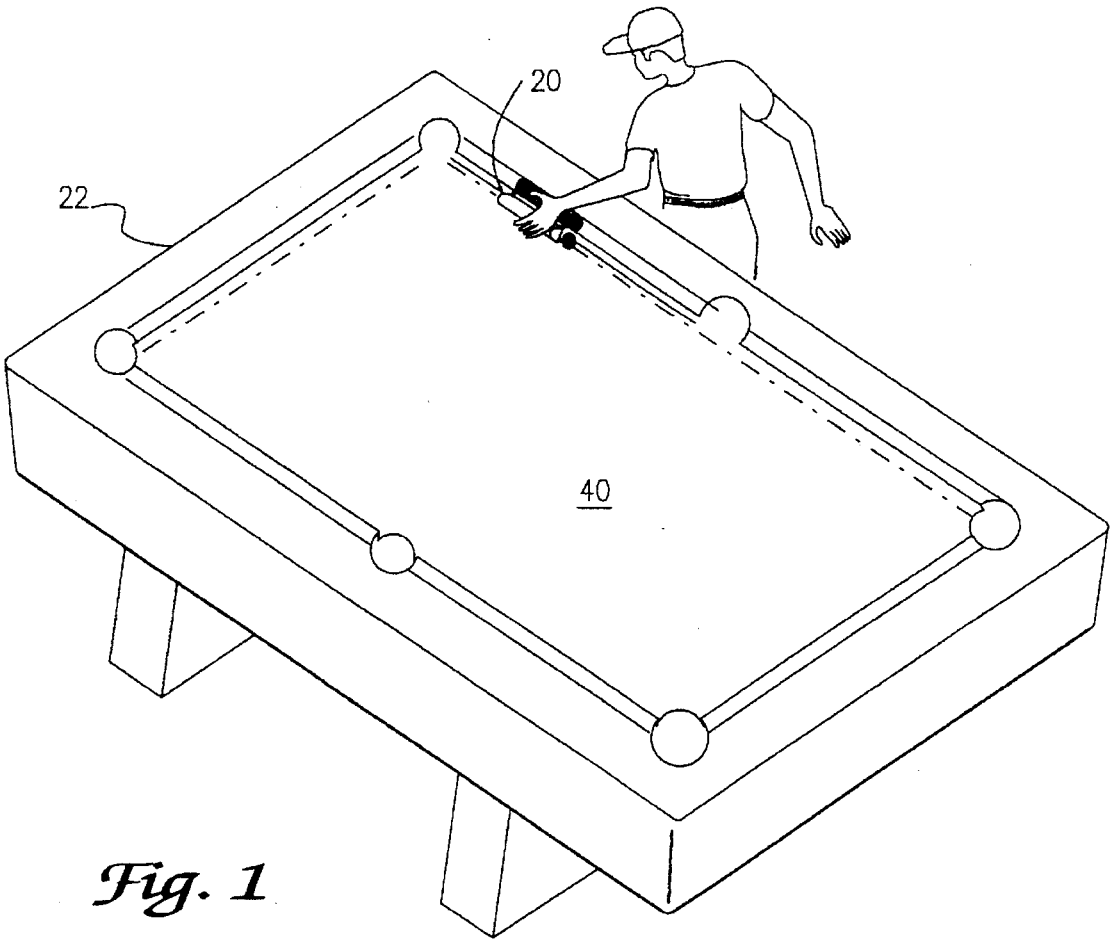
FIG. 1 is a perspective view of the instant invention in use on a pool table.

Turning now to FIG. 1, where the use of a pool table brush 20 made according the principles taught herein has been illustrated while using the pool table brush 20 to clean along the rails of a pool table 22. It should be noted that while the pool table brush 20 has been shown in use while cleaning a pool table, the unique features of the pool table brush 20 made in accordance to the principles taught herein can be highly beneficial for when using the invention to clean snooker tables or other billiard tables.

Figure 2:
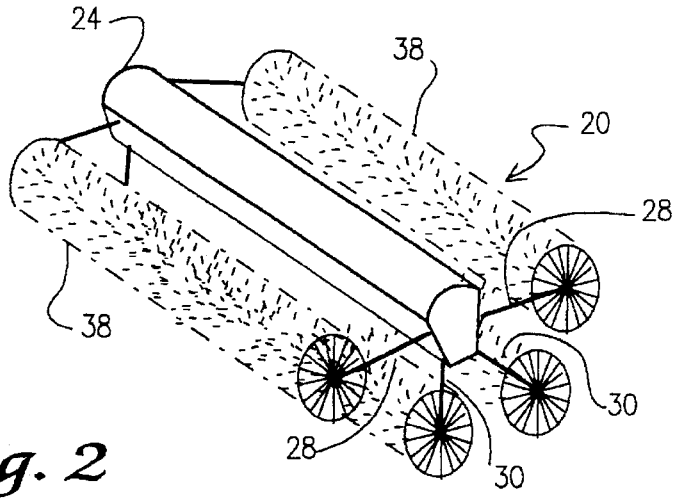
FIG. 2 is a perspective view of a preferred embodiment of the instant invention.

Turning now to FIG. 2, where a highly preferred embodiment of the pool table brush 20 has been illustrated showing the invention includes an elongated handle 24 which includes a longitudinal body 26, which in the highly preferred embodiment is integral to the elongated handle 24. Attached to the longitudinal body 26 is at least one of a first mounting means 28, or bristle mounting supports, for supporting bristles and at least one of a second mounting means 30, or second bristle mounting supports, for supporting bristles. As shown in the highly preferred embodiment illustrated in FIG. 2, the pool table brush 20 will preferably include a pair of the first mounting means 28 for supporting bristles, each mounted on opposite sides of the longitudinal body 26, and a pair of the second mounting means 30 for supporting bristles, each also mounted on opposite sides of the longitudinal body 26.

Figure 3:
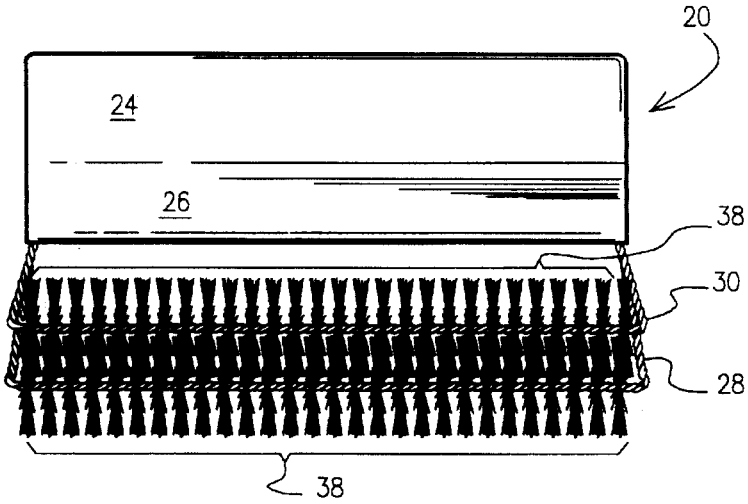
FIG. 3 is a side view of an embodiment of the invention.
Figure 4:
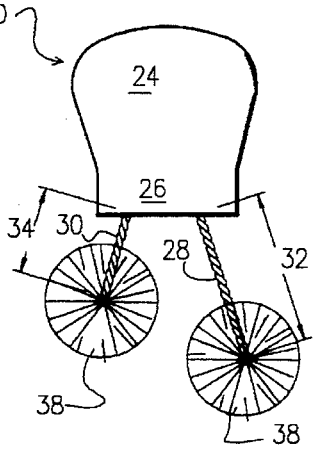
FIG. 4 is an end view of an embodiment of the invention, the view clearly illustrating the difference in length between two mounting means for supporting bristles used with the invention.

Referring now to FIGS. 3 and 4, it can seen that the first mounting means 28 for supporting bristles and the second mounting means 30 for supporting bristles should be arranged such that first mounting means 28 for supporting bristles project a first distance 32 from the longitudinal body 26. Also, the second mounting means 30 for supporting bristles projects a second distance 34 from the longitudinal body 26. In a highly preferred embodiment, the first distance 32 of projection of the first mounting means 28 is greater than the second distance 34 of projection of the second mounting means 30.

The difference in the first distance 32 of projection of the first mounting means 28 and the second distance 34 of projection of the second mounting means 30 is important for the instant invention, since the pool table bumper 36 is typically covered in a felt material. Since the bumper 36 typically includes an upper surface 42 and a lower surface 44, and the upper surface 42 is larger than the lower surface 44, it is highly advantageous to produce the pool table brush 20 where the first distance 32 of projection of the first mounting means 28 is greater than the second distance 34 of projection of the second mounting means 30; since this arrangement allows the bristles mounted on the first mounting means 28 to reach the entire upper surface 42 before the second mounting means 30 reaches the intersection of the lower surface 44 of the bumper 36 and the surface 40 of the pool table 22.

Thus, it is contemplated that the first distance 32 of projection of the first mounting means 28 and the second distance 34 of projection of the second mounting means 30 may be the same if the felt covering on the upper surface 42 and the lower surface 44 of pool table bumpers 36 were of the same size. Also, it is contemplated that the first distance 32 of projection of the first mounting means 28 and the second distance 34 of projection of the second mounting means 30 may be the same if the second mounting means 30 were made of a material with a resiliency that would allow the second mounting means 30 to flex in order to allow the first mounting means to reach the entire upper surface 42 of the bumper 36.

Thus as has been illustrated in FIG. 4, the first mounting means 28 for supporting bristles and the second mounting means 30 for supporting bristles are preferably mounted in a spaced apart relationship to one another, and the first mounting means 28 for supporting bristles and second mounting means 30 for supporting bristles will preferably diverge from one another. This arrangement has been found to be of particular benefit in the cleaning of pool tables. It has been discovered that by using a system that incorporates the first mounting means 28 for supporting bristles and second mounting means 30 for supporting bristles one can fabricate a pool table brush which can give good support to bristles as the bristles are placed deep into the crevicee created between a pool table's bumper 36 and the surface 40 of the pool table.

Figure 7:
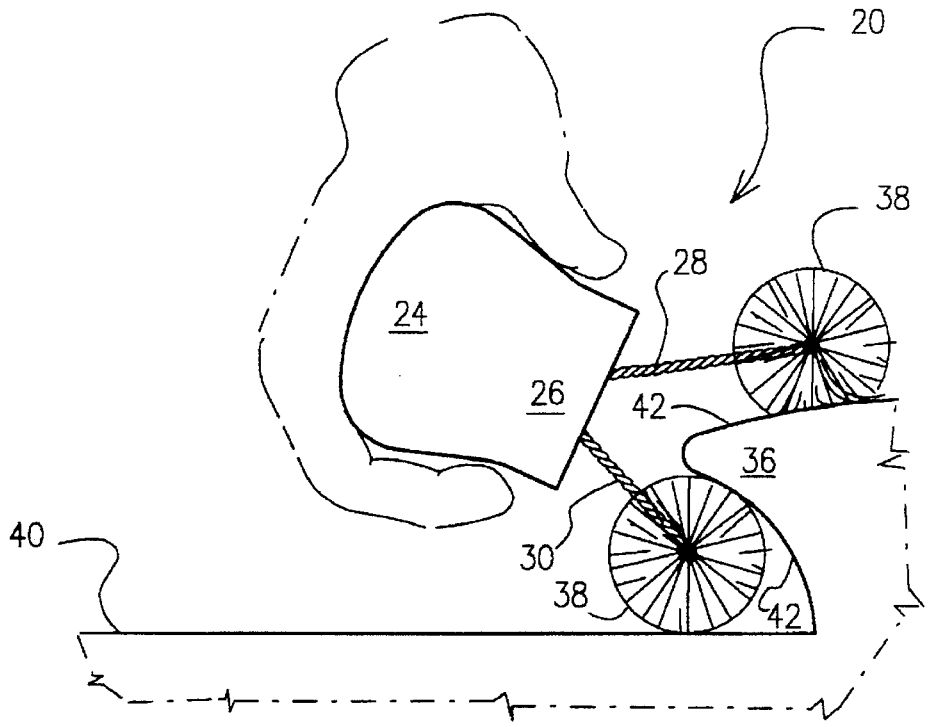
FIG. 7 is an end view of an embodiment of the invention being used to clean over and under the pool table bumper at the same time.
Figure 8:
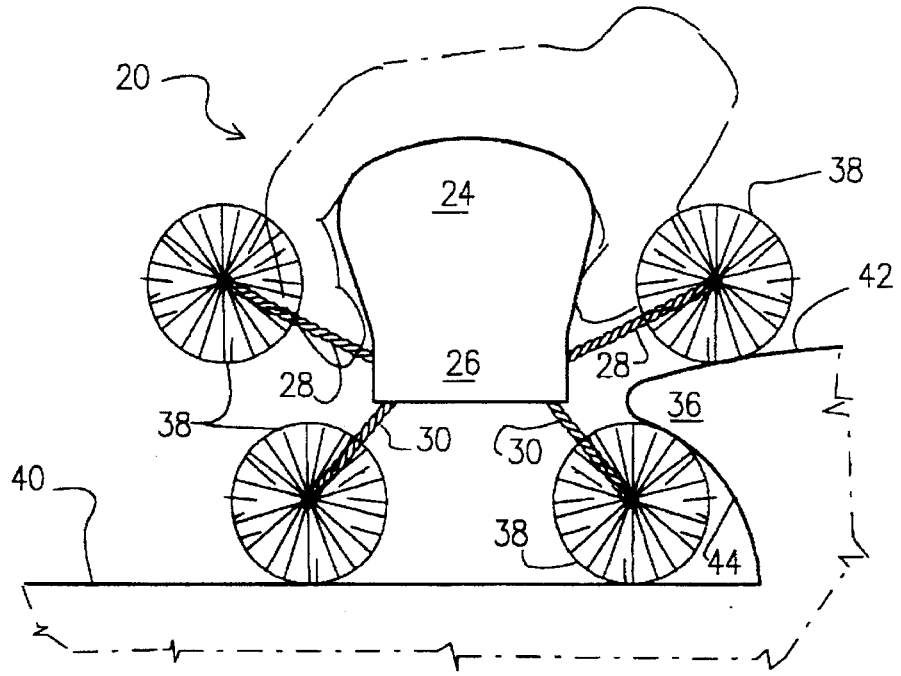
FIG. 8 is an end view of the highly preferred embodiment, also illustrated in FIGS. 2, 5, and 6, the invention being used to clean over and under the pool table bumper at the same time.

Thus as has been shown on FIGS. 7 and 8, the bristle support arrangement of the instant invention permits the user to reach under the pool table bumper 36 while at the same time allowing the user to scrub the top, easily accessible, portion of the bumper. Also, it is important to note that the first mounting means 28 for supporting bristles and second mounting means 30 for supporting bristles are preferably made of a generally U-shaped twisted wire of 12 gage wire or the like, or another metallic core which holds bristles 38 of a plastic synthetic material such as nylon or of a natural source, such as animal hair could be used. The twisted wire core can produce a pattern of radially protruding bristles 38, and which in a highly preferred embodiment is of approximately two inches in diameter. The radially protruding bristles 38 can define a generally cylindrical brush shape which has been found to be particularly effective at cleaning out crevasses such as the region between the pool table bumper 36 and the surface 40 of the pool table 22.

Also, the divergence and resiliency of the first mounting means 28 for supporting bristles and second mounting means 30 for supporting bristles will ensure that the leading edge of the bumper 36 will be appropriately cleaned by the bristles 38 as the bristles are withdrawn from the bumper 36. In other words, the pairing of the first mounting means 28 for supporting bristles and second mounting means 30 for supporting bristles allows cleaning of both sides of the bumper 36 at the same time; however, the resilient nature of the first mounting means 28 for supporting bristles and second mounting means 30 for supporting bristles will also allow the bristles 38 to reach the surface 40 of the pool table 22, and thus clean the three surfaces, the upper surface 42 of the bumper, the lower surface of the bumper 44, and the surface 40 of the pool table 22 at the same time.

Figure 5:
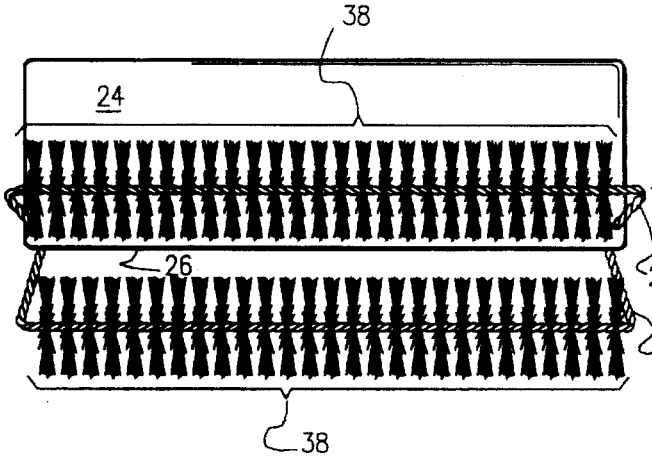
FIG. 5 is a side view of a highly preferred embodiment of the invention.
Figure 6:
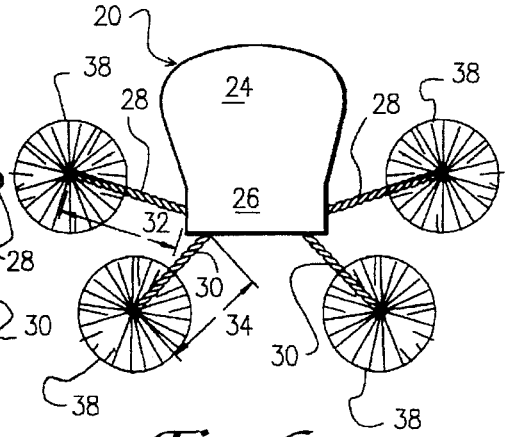
FIG. 6 is an end view of the highly preferred embodiment of the invention as illustrated in FIG. 5, the view clearly illustrating the difference in length between at least two of mounting means for supporting bristles used with the invention.

In the highly preferred embodiment illustrated in FIGS. 2, 5 and 6 the first distance 32 of projection of the first mounting means 28 is approximately two inches and the second distance 34 of projection of the second mounting means 30 is approximately one and one-half inches. Also, in the highly preferred embodiment illustrated in FIGS. 2, 5 and 6 the distance between the center of the radially protruding bristles for the pair of second mounting means 30 is about two inches, while the distance between the center of the radially protruding bristles of the first mounting means 28 is about four inches.

Moreover, since the as the cross section of the bumper 36 is not constant, this results in the crevice between the bumper 36 and the surface 40 of the pool table 22; the crevice also not having a constant cross section. Therefore, the resiliency of the first mounting means 28 for supporting bristles and second mounting means 30 for supporting bristles permits the bristles 38 to contact the surfaces of the bumper 36 and the surface 40 of the pool table 22.

Referring once again to FIGS. 3 and 4, it can be seen that the first mounting means 28 for supporting bristles as well as the second mounting means 30 for supporting bristles are substantially parallel to the longitudinal body 26 that is integral with the elongated handle 24 of the pool table brush 20. This arrangement takes advantage of the ability to form or cover a flat surface under the first mounting means 28 for supporting bristles and the second mounting means 30 for supporting bristles. Thus the resulting brush is particularly useful for sweeping under the bumper areas as well as over the large flat portions of the surface 40 of the pool table 22.

Figure 9:
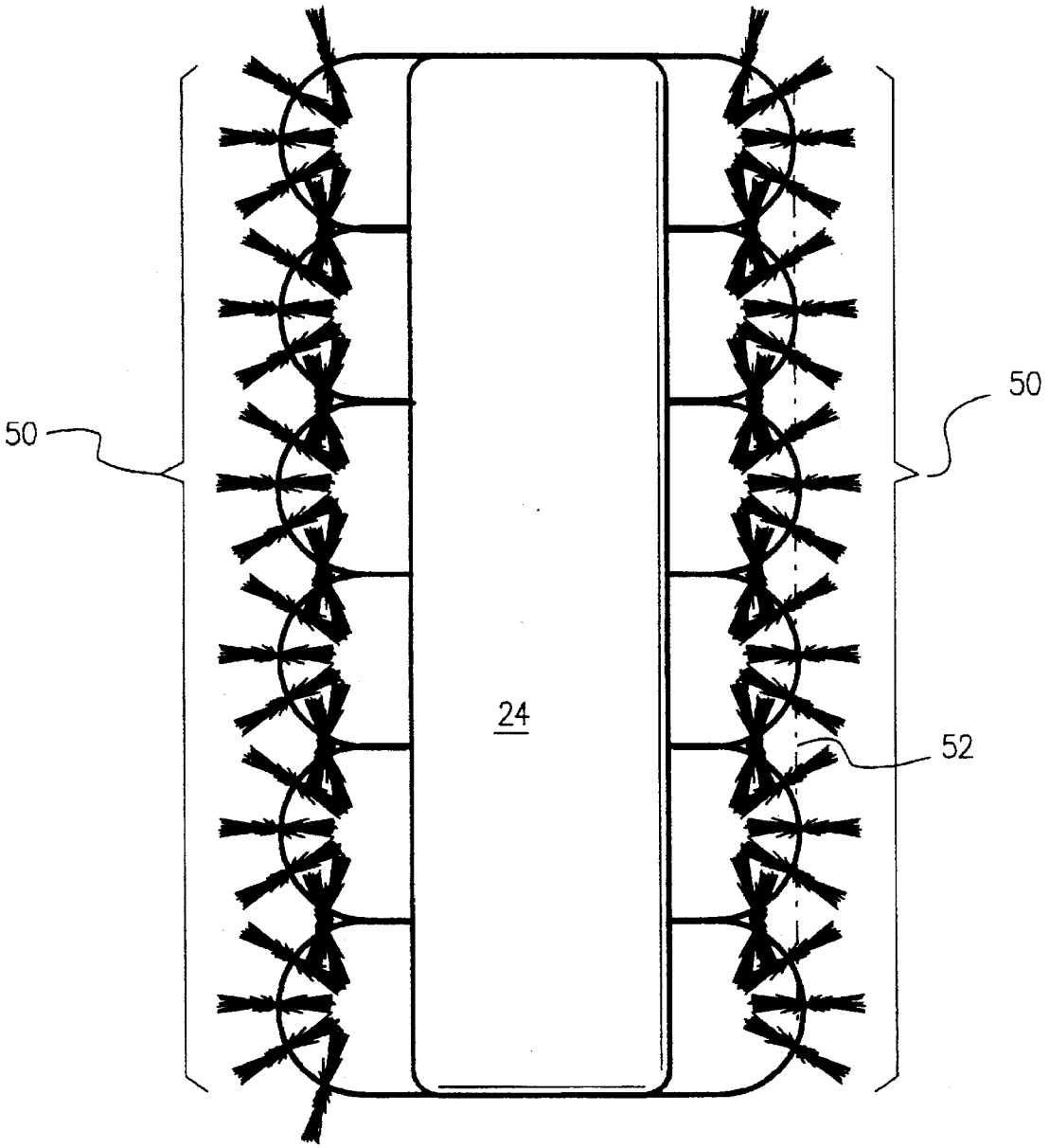
FIG. 9 is a plan view of alternative manner of providing bristles along a brush having an elongated body.

Thus, with the preferred embodiment of the instant invention one may place the pool table brush 20 with the first mounting means 28 for supporting bristles and the second mounting means 30 for supporting bristles at a slight angle to the bumper 36 so that the sweeping motion drives dirt and debris out from under the bumper 36 and towards the center of the table. To accomplish these new and useful functions, it has been discovered that one should use the preferred embodiments as discussed herein. However, it is contemplated that variations of the specific preferred embodiments may be employed. For example, as shown on FIG. 9, a surface or line of bristles may be achieved by placing several arched sections 50 of twisted wire core with radially protruding bristles, the series of arched sections defining a linear edge 52, that, while being more difficult to manufacture, can perform the functions of the preferred embodiments described herein.

Thus it is important to note that the preferred embodiment also offers advantages in simplicity of manufacture. Accordingly, the elongated handle 24 portion of the preferred embodiment of the pool table brush 20 is integral to the longitudinal body 26, since this embodiment will allow fabrication of both the handle 24 and the longitudinal body 26 from a single piece of wood having a constant cross section. However, it is contemplated that variations in the shape of the handle 24 may be made to offer ergonomic advantages, without departing from the scope and spirit of the instant invention.

Thus it can be appreciated that the above described embodiments are illustrative of lust a few of the numerous variations of arrangements of the disclosed elements used to carry out the disclosed invention. Moreover, while the invention has been particularly shown, described and illustrated in detail with reference to preferred embodiments and modifications thereof, it should be understood by that the foregoing and other modifications are exemplary only, and that equivalent changes in form and detail may be made without departing from the true spirit and scope of the invention as claimed, except as precluded by the prior art.

What is claimed is:

1. A brush for cleaning a pool table, the brush comprising:

a handle having:

a first mounting means for supporting bristles and a second mounting means for supporting bristles, the first mounting means being substantially parallel to and projecting from said handle, and the second mounting means being substantially parallel to and projecting from said handle, the first mounting means being spaced apart and diverging from the second mounting means, and the first mounting means projecting a greater distance from said handle than the second mounting means; and bristles projecting from the first mounting means for supporting bristles and from the second mounting means for supporting bristles.

2. A brush for cleaning a pool table according to claim 1, wherein the first mounting means for supporting bristles and the second mounting means for supporting bristles are of a resilient material.

3. A brush for cleaning a pool table according to claim 2, wherein the first mounting means for supporting bristles and the second mounting means for supporting bristles include a twisted metallic core.

4. A brush for cleaning a pool table according to claim 3, wherein said bristles protrude from the twisted metallic core in a radial fashion.

5. A bristle support system for cleaning mounting on a handle on a brush for cleaning a pool table, the bristle support system comprising:

a first longitudinal mounting means for supporting bristles, the first mounting means being substantially parallel to and projecting a first distance from the handle;

a second longitudinal mounting means for supporting bristles, the second mounting means being substantially parallel to and projecting a second distance from the handle, the distance of projection of the second mounting means being less than the distance of projection of the first mounting means, and the second mounting means being spaced apart and diverging from the first mounting means.

6. A bristle support system according to claim 5, wherein the first mounting means for supporting bristles and the second mounting means for supporting bristles are of a resilient material.

7. A bristle support system according to claim 6, wherein the first mounting means for supporting bristles and the second mounting means for supporting bristles include a twisted metallic core.

8. A bristle support system according to claim 7, wherein said bristles protrude from the twisted metallic core.

9. A bristle support system according to claim 7, wherein said bristles protrude from the twisted metallic core in a generally radial fashion.

10. A bristle support system according to claim 9, wherein said bristles are of a plastic material.

11. A bristle support system according to claim 9, wherein said bristles are of animal hair.

12. A brush for cleaning the surface of a pool table, the brush comprising:

an elongated handle;

at least one of a first mounting means for supporting bristles at a first distance and in a substantially parallel relationship relative to said handle;

at least one of a second mounting means for supporting bristles at a second distance and in a substantially parallel relationship relative to said handle, the first mounting means being spaced apart and diverging from the second mounting means, and the first distance being greater than the second distance; and bristles projecting from the first mounting means for supporting bristles and from the second mounting means for supporting bristles.

13. A brush for cleaning the surface of a pool table according to claim 12, wherein the first mounting means for supporting bristles and the second mounting means for supporting bristles include a twisted metallic core.

14. A brush for cleaning the surface of a pool table according to claim 13, wherein said bristles protrude from the twisted metallic core in a radial fashion.

* * * * *